United States Patent [19]

Bolton

[11] Patent Number: 4,681,337

[45] Date of Patent: Jul. 21, 1987

[54] SAFETY SKI HARNESS

[76] Inventor: John D'Arcy Bolton, 5 Shiloh Cir., Irvine, Calif. 92714

[21] Appl. No.: 855,926

[22] Filed: Apr. 25, 1986

[51] Int. Cl.[4] ..... A63C 9/08

[52] U.S. Cl. ..... 280/615; 280/629

[58] Field of Search ..... 280/11.3, 11.31, 614, 280/615, 616, 623, 624, 629

[56] References Cited

U.S. PATENT DOCUMENTS

| | | | |
|---|---|---|---|
| 2,649,306 | 8/1953 | Hilding | 280/614 |
| 3,359,010 | 12/1967 | Wick | 280/620 |
| 4,635,955 | 1/1987 | Zoor | 280/614 |

FOREIGN PATENT DOCUMENTS

| | | |
|---|---|---|
| 2374059 | 5/1976 | France . |
| 624015 | 7/1981 | Switzerland . |

*Primary Examiner*—John J. Love
*Assistant Examiner*—Richard Camby

[57] ABSTRACT

The apparatus consists of two plates, attached together at their ends by a pivot pin with a wing nut on it. The plates can be rotated about this central pivot and the resistance to rotation can be controlled by the user by tightening or losening the pivot pin. One end of this combination of plates is attached to the skiers shoe, the other end of the pair of plates has a semicircular area cut away, the resulting curving arch fitting a rod vertically attached to the ski. In use, as the skiers heel rises and falls, the combined plates slide up and down on the rod allowing vertical movement but preventing lateral movement. In the event of an accident and a rotation of the ski the plates rotate over each other and disconnect from the rod thereby preventing a twist and injury of the skier's leg. The amount of force required before the plates disconnect from the rod is adjustable by the user.

1 Claim, 1 Drawing Figure

SAFETY SKI HARNESS

CROSS REFERENCES

U.S. Pat. No. 3,359,009, Dec. 19, 1967, inventor H. Hinterholzer. Swiss Pat. No. 0624015 Filed July 1981 Inventor Oskar Kastli. Franch Publication No. 2 374 059, Brevet No. 76 37852, Filing date, Dec. 14, 1976, Inventor Claud Terracol, Bolton U.S. application Ser. No. (abandoned) 585,918.

FEDERAL RESEARCH RIGHTS

The Federal Government made no contribution to the research and/or development of this invention and has no rights in the invention or the patent.

FIELD OF THE INVENTION

This apparatus relates to ski boot harnesses.

DESCRIPTION OF THE PRIOR ART

At the present state of the art a simple ski harness been described (FR No. 197808), that has a plate attached to a ski shoe that has a hole in it. The plate rides up and down a curved rod attached to the ski as the skier's boot moves up and down.

In the event that the skier falls or hits something the ski can be rotated. Because, in the present state of the art, the ski and the skiers leg are firmly joined by the apparatus, the same accident also forcibly rotates the skiers leg and serious injury frequently results.

SUMMARY OF THE INVENTION

The apparatus consists of two plates, attached together at their ends by a threaded pivot pin with a wing nut on it and more or less in line. The plates can be rotated about this central pivot pin. One end of the combination of plates is attached to the skiers shoe, the other end of the combination of plates has a semicircular area cut away, the depression called the "rod notch" in this patent application, and fitting and riding up and down upon a slightly curved rod attached in an approximately vertical position to the ski behind the skier's boot.

In use, as the skier skies along, his shoe moves up and down, guided by the rod notch in the plate sliding on the ski rod. The lateral movement of the shoe is restricted because the pair of plates are attached to his shoe and rod notch fits the rod attached to his ski.

In the event of an accident that causes the ski to be twisted, the pair of plates pivot one on the other, rotating on the central pivot pin. With a little deflection the rod notch is pulled off the ski rod and the skiers leg is freed from attachment. As a result of the disconnection the ski may be rotated, but the skiers leg is not forcibly rotated and an injury to the skier is avoided.

The resistence to rotation of the plates is controlled by the user by tightening or loosening the wing nut on the central pivot. A skier with strong legs can set the resistance to disconnection very high, a skier with weaker legs can reduce the amount of resistence to disconnection.

DESCRIPTION OF THE PREFERRED EMBODIMENT

Figure 1:
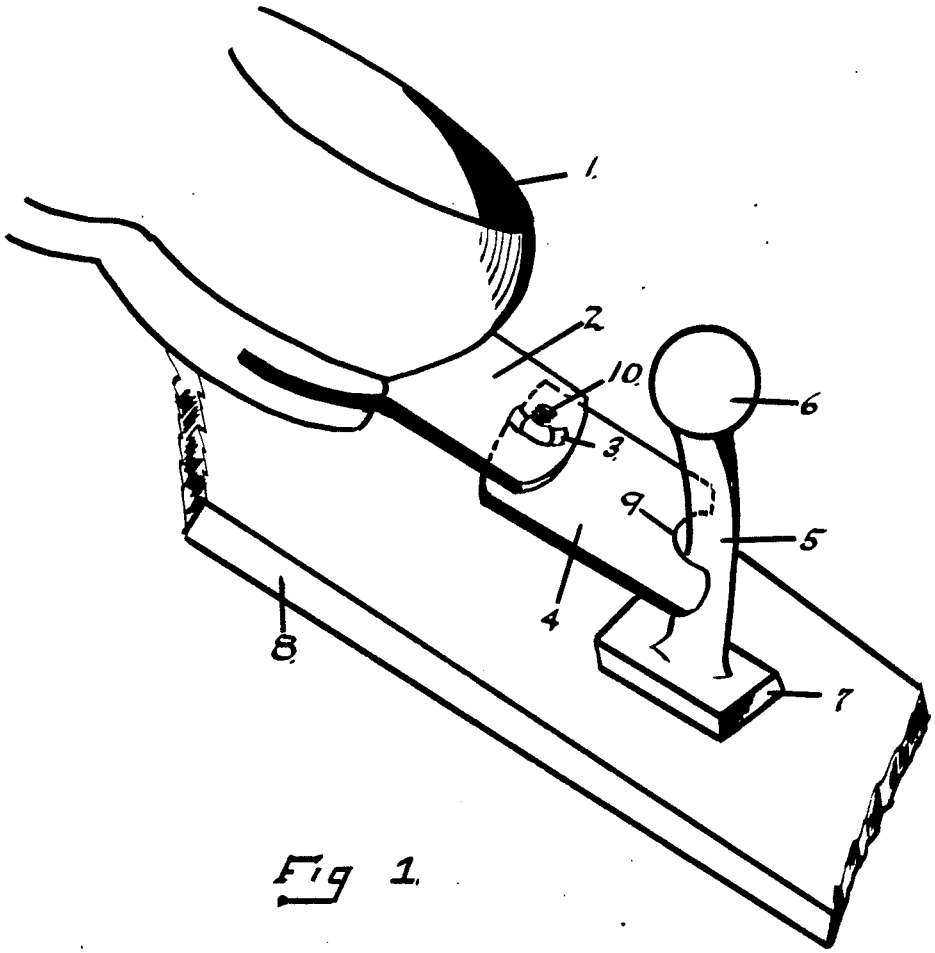
FIG. 1 is diagrammatic view of the apparatus.

In describing one selected embodiment of my invention illustrated in the drawing, specific terminology is resorted to for the sake of clarity; however, it is not intended to be limited to the specific terms so selected and it is to be understood that each specific term includes all technical equivalents which operate in a similar manner to accomplish a similar purpose.

Turning now to the specific embodiment of my invention selected for illustration, in FIG. 1,

1: ski shoe,
2: shoe plate,
3: wing nut,
4: rod plate,
5: curved ski rod
6: ball stop
7: curved ski rod attachment to ski,
8: ski,
9: rod notch,
10: central pivot pin.

OPERATION OF THE APPARATUS

The skier attaches his shoe to the ski with any convenient toe harness and attaches his heel by pivoting the plates about the pivot pin 10 so that the rod notch 9 may be placed upon the curved ski rod 5. Now he aligns the plates and tightens the wing nut 3 until there is the proper resistance to deflection. Skiers with weak legs would adjust the plates so that a little torque would deflect them, skiers with strong legs will set them so that it requires more torque to deflect them.

The skier skies in the normal way, his shoe moving up and down at the heel but restrained from lateral movement by the rod notch 9 riding upon the curved ski rod 5 and restrained from lateral movement by pressure on the ski rod. His shoe is restrained from riding off the end of the rod by the stop ball 6.

In the event of an accident and the ski is rotated, the plates rotate upon the central pivot 10 and the rod notch 9 released from the ski rod 5. Now the ski may rotate but the skiers legs is not forcibly rotated.

It is to be understood that the form of my invention selected for illustration here and described herein is to be taken as a preferred embodiment. For example equivalent elements may be substituted for those illustrated and described; any kind or sort of plates may be used; they may be attached anywhere near the skiers heel. The central pivot may be of any kind or form; and means may be used to allow the plates to move over each other. The curving rod may be any shape, not necessarily round. There may be any means to alter the resistance to deflection of the plates one over the other. In this patent ski "shoe" includes all manner of skiing footwear. This patent uses the term "rod notch" to refer to any means of allowing the plate to ride up and down on the ski rod while restraining lateral movement of the plates.

An advantage of my invention is that the ski harness will automatically free the skiers foot and leg in the event that there is an accident that rotates the ski, thus avoiding an injury to the skier. Another advantage is that the amount of torque required to release the apparatus may be conveniently adjusted by the user.

Having thus described and disclosed my invention I claim:

1. A boot binding device for removably holding a ski boot to a ski that permits vertical movement of the ski boot and restrains lateral movement of the boot and that releases the boot in an accidental fall comprising:

a curved ski rod fixed to the ski and curved to follow the arc traced by the ski boot heel as it moves vertically with the toe of the boot fixed about a pivotal point, a rod plate having a cut away groove at one end to accommodate said ski rod, a boot plate fixed at one end to said ski boot and connected to said rod plate by a pivot pin that extends through holes in the plates at their other ends, said pivot pin having an adjustment means to adjust the bias of the two plates towards each other and thus adjust the extent of lateral retention of the boot, in the event of a fall the two plates pivot about the pivot pin to release the boot from the lateral retention of the ski rod.

* * * * *